US006168401B1

(12) United States Patent
Schenck et al.

(10) Patent No.: US 6,168,401 B1
(45) Date of Patent: Jan. 2, 2001

(54) HYDRAULIC CONVEYING DEVICE

(75) Inventors: Kai Schenck, Remscheid; Dieter Otto, Ennepetal, both of (DE)

(73) Assignee: Luk Automobiltechnik GmbH & Co. KG (DE)

( * ) Notice: Under 35 U.S.C. 154(b), the term of this patent shall be extended for 0 days.

(21) Appl. No.: 09/305,265

(22) Filed: May 4, 1999

(30) Foreign Application Priority Data

May 4, 1998 (DE) ..... 198 19 887

(51) Int. Cl.[7] ..... F04C 2/356; F04C 15/00
(52) U.S. Cl. ..... 418/47; 418/248; 418/249
(58) Field of Search ..... 418/47, 248, 249, 418/251; 417/540

(56) References Cited

U.S. PATENT DOCUMENTS

| | | | | |
|---|---|---|---|---|
| 1,280,601 | * | 10/1918 | Weidenbach | 418/248 |
| 1,770,141 | * | 7/1930 | Meyer | 418/248 |
| 2,446,194 | * | 8/1948 | Samiran | 418/47 |
| 2,492,687 | * | 12/1949 | Dall | 418/249 |
| 3,128,708 | * | 4/1964 | Henning | 418/249 |
| 3,276,386 | * | 10/1966 | Fanshawe | 418/248 |
| 3,650,642 | * | 3/1972 | Cygnor et al. | 418/47 |

FOREIGN PATENT DOCUMENTS

| | | | |
|---|---|---|---|
| 342302 | | 8/1920 (DE) . | |
| 4436968 | | 4/1996 (DE) . | |
| 0481347 | | 4/1992 (EP) . | |
| 592119 | * | 4/1994 (EP) | 418/251 |
| 922121 | | 3/1963 (GB) . | |

OTHER PUBLICATIONS

Patent Abstract of Japan No. 6–229377 of Aug. 16, 1994, vol. 18/No. 607.

* cited by examiner

*Primary Examiner*—John J. Vrablik
(74) *Attorney, Agent, or Firm*—Ostrolenk, Faber, Gerb & Soffen, LLP

(57) ABSTRACT

An hydraulic conveying device, in particular for conveying diesel fuel for an internal-combustion engine in motor vehicles, with a housing provided with at least one conveying chamber as well as a displacement unit rotor arranged in the conveying chamber. Rotation of the displacement unit forms pump chambers with varying volumes by means of which a fluid is conveyed from a suction connection of the conveying device to a pressure connection of the conveying device. The conveying devices includes a screen or wall with openings for retaining a quantity of the fluid to be conveyed in the conveying chamber when a supply of fluid by way of the suction connection is interrupted.

26 Claims, 3 Drawing Sheets

HYDRAULIC CONVEYING DEVICE

BACKGROUND OF THE INVENTION

The invention relates to an hydraulic conveying device, in particular for conveying diesel fuel for an internal-combustion engine in motor vehicles, with a housing provided with at least one conveying chamber as well as a displacement unit arranged in the conveying chamber, rotation of the displacement unit resulting in the formation of pump chambers with varying volumes by way of which a fluid is conveyed from a suction connection of the conveying device to a pressure connection of the conveying device.

Hydraulic conveying devices of the type defined in the introduction are known. They are used for example as fuel-conveying pumps in motor vehicles, in order to draw in the contents of a tank and to convey them to an injection unit of the internal-combustion engine. The hydraulic conveying devices are constructed for example in the form of blocking-vane pumps, gear pumps or vane-cell pumps. The hydraulic conveying devices have to ensure that fuel is conveyed continuously out of the tank and is supplied with an increase in pressure of several bar for example to a high-pressure pump of the injection unit. This must be provided for under all operating conditions of the motor vehicle. In particular, if a supply of fuel present in the tank runs out, a so-called empty running of the tank, air is drawn in through the conveying device.

Air is drawn in in this way until fuel still present in supply lines to the internal-combustion engine is used up, and the internal-combustion engine stops as a result of a lack of fuel. The conveying device is dried out as it were by the air flow conveyed through the conveying device in this case, so that as a result of a minimal clearance—required for operating the conveying device—between the movable and stationary parts of the conveying device it is no longer possible to seal off the clearance by the fuel. In particular, when the tank is re-filled with fuel and drawing-in takes place by way of the conveying device, the problem arises that the leakage points inside the conveying device render the build-up of pressure at least difficult, if not actually impossible. In particular, a rapid and reliable supply of fuel to the internal-combustion engine is possible only after a relatively long run-up phase.

SUMMARY OF THE INVENTION

The object of the invention is to provide an hydraulic conveying device of the type defined in the introduction, in which a reliable and rapid run-up is possible in a simple manner in any operating situation, and in particular even at low rotational speeds of the drive.

This object is attained according to the invention by an hydraulic conveying device with a fluid conveying chamber, having a pumping rotor in it and devices which retain fluid in the pumping chamber when fluid supply from the suction connection to the conveying chamber is interrupted. Preferably, such a device comprises a pressure collecting chamber above the conveying chamber. Since the conveying device comprises means which retain a quantity of the fluid to be conveyed in the conveying chamber when a supply of fluid by way of the suction connection is interrupted, it is advantageously possible, even when the supply of a fluid to be conveyed runs out, to prevent the hydraulic conveying device from running dry. The fluid remaining in the conveying device, in particular in a conveying chamber of the conveying device, prevents an interruption of the sealing effect between the moved and fixed parts of the conveying device, so that at all times a sealing film of fluid remains in gaps existing between them as a result of manufacture.

A preferred embodiment of the invention provides a pressure-collecting chamber arranged substantially above the conveying chamber in the fitted position of the blocking-vane pump. In this way, it advantageously becomes possible for fluid remaining in the pressure-collecting chamber to flow back into the conveying chamber as a result of gravity when a supply of fluid is interrupted. The fluid collects in the conveying chamber, so that the conveying chamber lies below a residual-fluid level inside the conveying device. When the conveying device starts up again, fluid is thus immediately available, and can form a sealing film between the moved and stationary parts of the conveying device.

In particular, if the pressure ducts connecting the conveying chamber to the pressure-collecting chamber extend at an angle which ascends to a horizontal line extending through an axis of rotation, a satisfactory return of the residual fluid into the conveying chamber is assisted.

A further preferred embodiment of the invention provides that in blocking-vane pumps pressure outlets of the conveying chamber are connected by at least one fluid connection to spring chambers by way of which vanes are acted upon with a radially acting force by spring members arranged in spring chambers. In this way, it is in an advantageous manner, the residual fluid collecting in the conveying chamber can arrive directly in the spring chambers after the conveying device is started up again, and so the sealing of a clearance (gaps) from the radially movable to stationary parts of the displacement unit can take place immediately. This prevents a pressure build-up in the conveying device from being delayed by possible leakage points in the case of this clearance.

In addition, in a preferred embodiment of the invention, the pressure-collecting chamber is provided with at least one cross-sectional enlargement and/or at least one cross-sectional constriction. This cross-sectional enlargement or cross-sectional constriction respectively can advantageously produce a swirling of the fluid in the pressure-collecting chamber, and the swirling leads to retardation of the speed of flow. This makes it possible for the fluid present in the pressure-collecting chamber not to be pumped away completely through the pressure outlet when the conveying device is switched off following an interruption of the fluid supply. The quantity of fluid remaining in the pressure-collecting chamber is then available for filling the conveying chamber.

In addition, it is preferred if at least one wall, which has at least one through opening for the fluid, is provided inside the pressure-collecting chamber. This causes a banking-up in front of the wall, and, particularly when a fluid to be conveyed suddenly becomes absent, this banking-up leads to the possibility of air, which is conveyed instead of the fluid, then taking up the quantity of residual fluid which remains in the pressure-collecting chamber. This quantity of residual fluid is advantageously banked up at the at least one wall and is available for the return of the quantity of residual fluid into the conveying chamber.

In addition, it is preferred if the pressure-collecting chamber is formed by a free space of a portion of a housing of the conveying device. As a result, in particular if the housing is produced from a die-casting, it is possible to produce even irregular contour sections of the pressure-collecting chamber, for example the cross-sectional enlargements, cross-sectional constrictions, walls, pressure ducts and so forth, in a simple manner by means of known and reliably controllable methods.

Other objects and features of the invention are explained below in embodiments with reference to the accompanying drawings.

DESCRIPTION OF PREFERRED EMBODIMENTS

Figure 1:
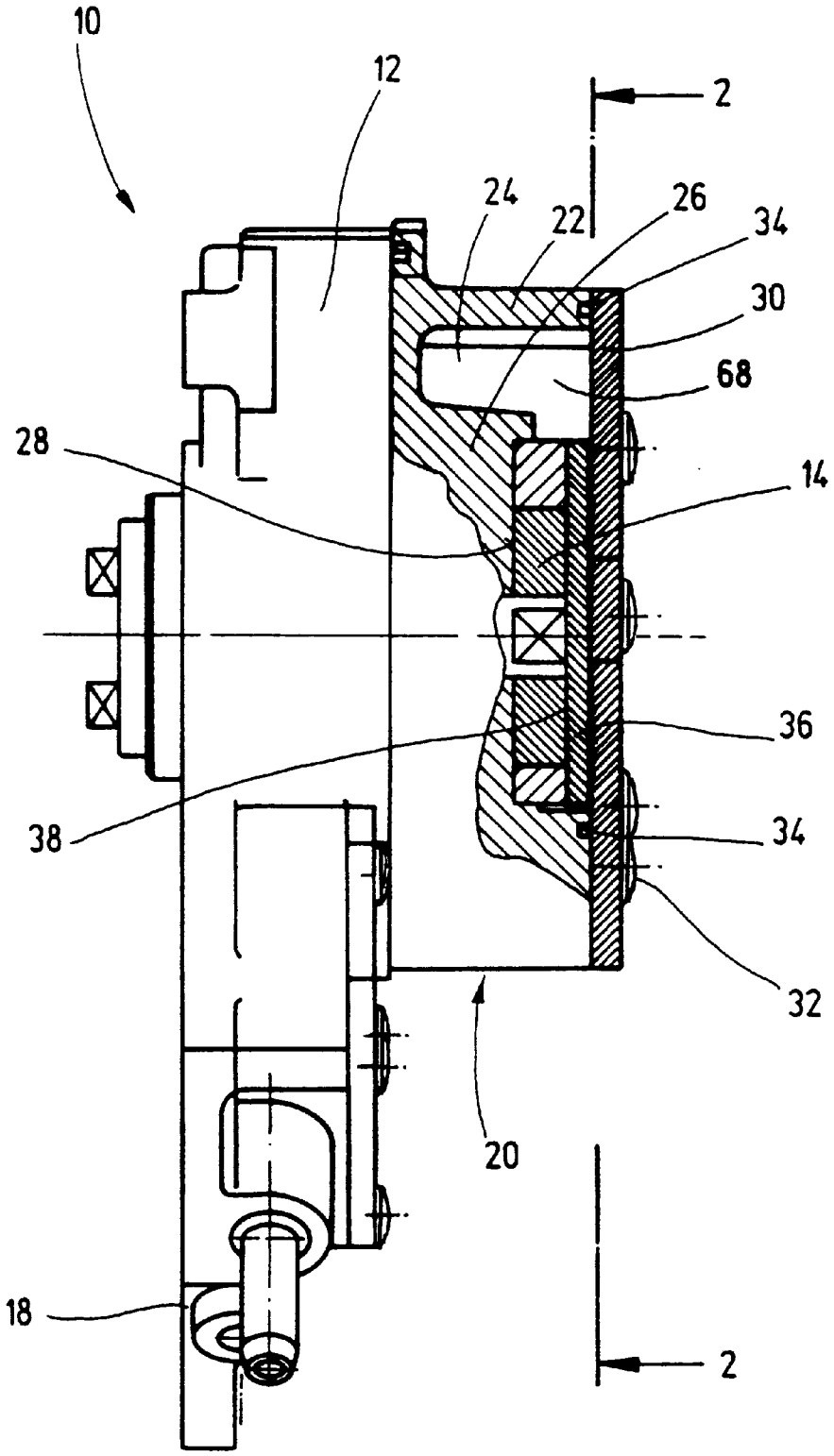
FIG. 1 is a view, partly in section, of a blocking-vane pump.

FIG. 1 shows a blocking-vane pump 10 in its actual fitting position during its use in accordance with its purpose, i.e. the portions shown at the top in the illustration are also in fact situated at the top. Blocking-vane pumps are used for example as fuel pumps in motor vehicles. The blocking-vane pumps pump fuel out of a tank to an injection unit of an internal-combustion engine for making the fuel available at increased pressure, for example at several bar.

Figure 2:
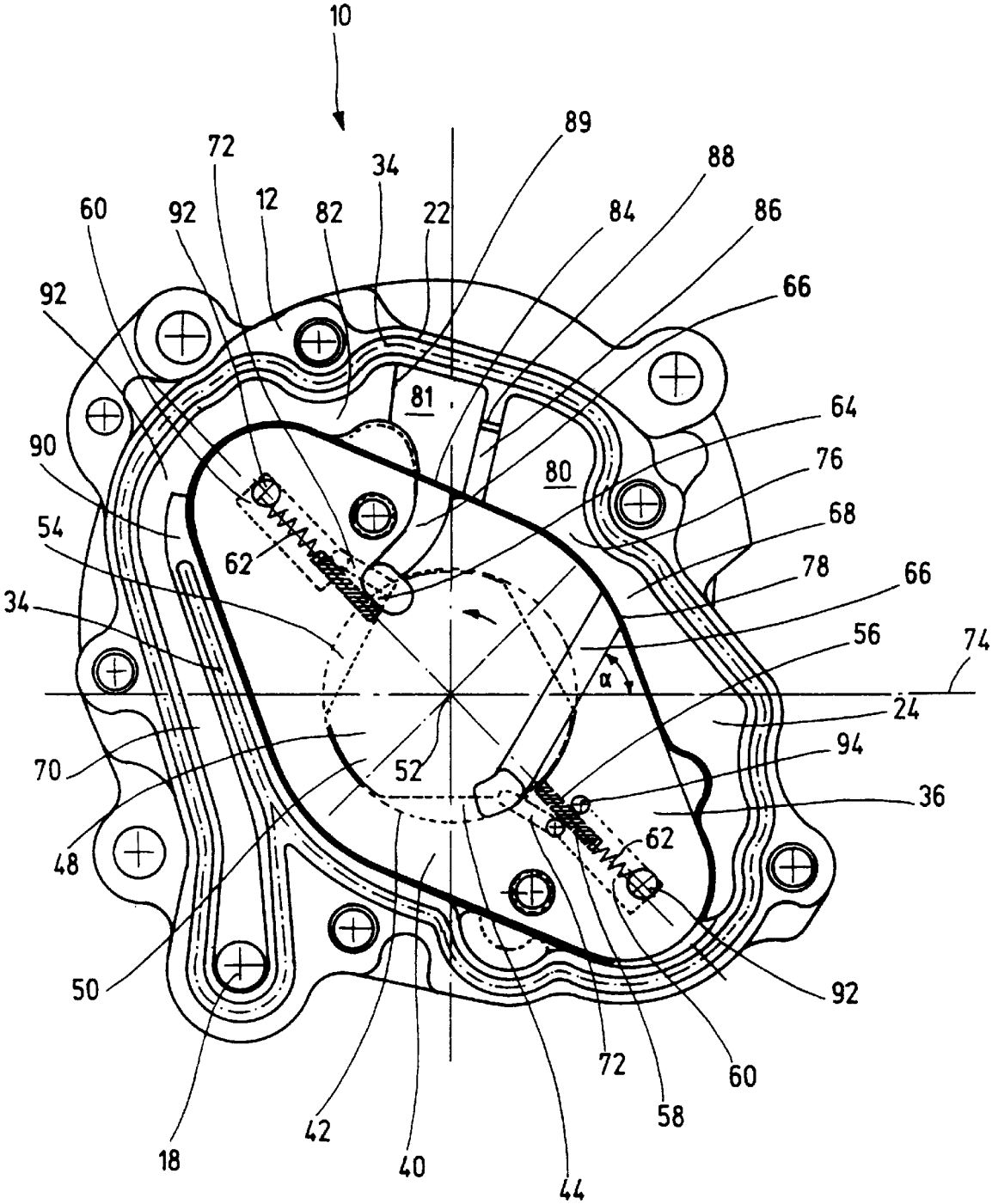
FIG. 2 is a plan view of the blocking-vane pump along the line 2—2 in FIG. 1 with the cover removed.

The blocking-vane pump 10 comprises a housing 12 which is shown partly in section. A displacement unit 14, explained in detail with reference to FIG. 2, is arranged inside the housing 12. A fluid, which can be sucked to a suction connection (not shown) through a connecting line (not shown), is conveyed at increased pressure to a pressure connection 18 by the displacement unit 14. The pressure connection 18 is connected by a bore to the cylinder head for removing the fuel which is to be pumped and is under pressure.

The displacement unit 14 is arranged in a cup-shaped portion 20 of the housing 12. The housing portion 20 is formed by a continuous housing wall 22 which surrounds a free space 24. A platform 26, having an end face 28 on which the displacement unit 14 rests, is arranged inside the free space 24. The free space 24 is closed by a cover 30 which is securely connected to the housing portion 20 by fastening members 32, for example screw connections, tension-spring connections or the like. A joint between the cover 30 and the housing portion 20 is sealed off by a sealing device 34, for example, an O-ring of a resilient material inserted in a groove. A thrust plate 36, having an end face 38 facing the displacement unit 14, extends parallel to the end face 28 of the platform 26, and is arranged between the cover 30 and the displacement unit 14. The thrust plate 36 is pressed against the displacement unit 14 by screws and/or springs. The springs could, for example, be in the form of cup springs, which are supported on the cover 30. In addition, the thrust plate is pressed hydraulically against the displacement unit 14.

FIG. 2 is a plan view of the blocking-vane pump 10, in accordance with the line A—A indicated in FIG. 1, with the cover 30 removed. The same parts have the same reference numerals as in FIG. 1.

The displacement unit 14 arranged in the free space 24 is shown in FIG. 2, and parts of the displacement unit 14 that are covered by the thrust plate 36 are shown in broken lines. The displacement unit 14 comprises a middle plate 40 which lies in a plane manner between the platform 26 and the thrust plate 36. The middle plate 40 is provided with a cylindrical opening 42 which forms a conveying chamber 44 of the blocking-vane pump 10. A rotor 48, which, as viewed in cross-section, is in the form of a multiple-stroke camshaft, is arranged inside the conveying chamber 44. An outer periphery of the rotor 48 is determined by three so-called great circles or arcs which pass into one another by way of portions of smaller diameter. A diameter of the rotor in the region of the great circles or arcs substantially corresponds to an internal diameter of the opening 42, so that the rotor 48 with its cams 50 (in the region of the great circles or arcs) rests in a sealed manner against the inner wall of the opening 42. The rotor 48 is mounted on a rotation shaft 52 by which the rotor can be rotated. The rotation shaft 52 is driven by a motor drive for example. Pump chambers 54 situated between respective adjacent cams 50 are formed by the design of the cams 50 of the rotor.

Two slots 56 extend radially with respect to the rotation shaft 52 and vanes 58 are mounted in those slots to be radially displaceable therein. The slots are arranged diametrically opposite and are inside the middle plate 40. The vanes 58 are guided with little clearance inside the slots 56, i.e. one width of the slots 56 corresponds substantially to the thickness of the vanes 58, and one depth of the slots 56 (viewed into the plane of the paper in FIG. 2) corresponds to one depth of the vanes 58. The vanes 58 rest with the radial narrow edges thereof against the end face 28 of the platform 26 on the one hand and on the end face 38 of the thrust plate 36 on the other hand and span the space between those faces. The vanes 58 open into a spring chamber 60 which is likewise oriented substantially radially to the rotation shaft 52. A respective spring member 62, which is supported at one end on the base of the spring chamber 60 and at the other end on the vane 58, is arranged inside the spring chambers 60. The force of the spring members presses the vanes 58 against the peripheral wall of the rotor 48. A radial inward or outward movement respectively is imparted to the vanes 58 in accordance with the rotation of the rotor 48. In regions situated in front of the cams 50 in the direction of rotation the vanes are pressed radially outwards and in regions of the rotor 48 situated after the cams 50 in the direction of rotation they are pressed radially inwards by the force of the spring members. This forms pump chambers 54 with varying volumes in a known manner. The pump chambers are bounded by the vanes 58, the inner wall of the opening 42 and the outer contour of the rotor 48. As a result of the rotor 48 being rotated, for example anti-clockwise, the volumes of the pump chambers 54 in front of the vanes 58 are reduced and the volumes of the pump chambers 54 after the vanes 58 are increased. In the region of the increasing volumes, ducts (not shown in FIG. 2), which are connected to the suction connection 16 of the blocking-vane pump 10, open into the conveying chamber 44. A fluid is thus drawn in corresponding to the increase in the volumes of the pump chambers 54.

When the volumes of the pump chambers 54 in front of the vanes 58 are reduced the fluid previously drawn in is compressed in the pump chambers 54 and is forced out under increased pressure through pressure outlets 64. The pressure outlets 64 are connected to a pressure-collecting chamber 68 by way of pressure ducts 66. In accordance with the number of the pressure outlets 64 a corresponding number of pressure ducts 66 are provided, which all open jointly into the pressure-collecting chamber 68. In the example illustrated, the blocking-vane pump 10 comprises two vanes 58 with respective associated pressure outlets 64. In accordance with further embodiments the number of vanes and thus the number of pressure outlets can be smaller or larger than two.

The pressure-collecting chamber 68 is formed by the free space 24 which remains between the platform 26 and the wall 22 of the housing portion 20 (FIG. 1). The pressure-collecting chamber 68 is connected to the pressure connection 18 of the blocking-vane pump 10 by a pressure duct 70.

The spring chambers 60 or only the upper spring chamber 60 are or is connected to the pressure outlets 64 by way of ducts 72. The ducts 72 are formed for example by bores cut into the middle plate 40. The vanes 58 can be acted upon with conveying pressure from the rear by the ducts 72, so that the vanes 58 rest against the rotor 48 in every operating situation. This prevents the vanes 58 from being lifted slightly away from the contour of the rotor 48 as a result of a radial outward acceleration. The pressure built up in the spring chambers 60 by way of the ducts 72 thus assists the force of the spring members for pressing the vanes 58 against the rotor 48.

Instead of the ducts 72, a connection between the pressure outlets 64 and the spring chambers 60 can also be made by the radial grooves provided in the vanes 58.

The pressure ducts 66 connecting the pressure outlets 64 to the pressure-collecting chamber 68 extend at an angle to an imaginary horizontal line 74 extending through the rotation shaft 52. In the illustrated fitted position of the blocking-vane pump 10, the pressure ducts 66 thus ascend starting from the pressure outlet 64. In this case the pressure ducts 66 extend through the housing and the thrust plate. The shape of the pressure ducts 66 can be straight for example, as shown with the pressure duct 66 at the bottom in FIG. 2, or they can have a curved shape, as shown with the pressure duct 66 shown at the top.

The pressure-collecting chamber 68 is provided with at least one cross-sectional enlargement 76 as viewed in its longitudinal extension in the direction of the pressure connection 18. This means that the free cross-sectional area and thus the free passage area for a conveyed fluid are enlarged relatively abruptly. The cross-sectional enlargement 76 is situated in an area of the pressure-collecting chamber 68 which is arranged downstream of an opening 78 of the first pressure duct 66 into the pressure-collecting chamber 68 in the flow direction of the conveyed fluid. The cross-sectional enlargement 76 provides an abrupt enlargement of the available flow cross-section, causing swirling in the conveyed fluid in an area 80 of the pressure-collecting chamber 68 situated downstream of the cross-sectional enlargement 76. A ratio of the cross-sectional enlargement 76 of the pressure-collecting chamber 68 amounts for example to 1:3, i.e. in the area 80 of the pressure-collecting chamber 68 three times the free passage area is available for the fluid as compared with the area upstream of the cross-sectional enlargement 76. This ratio can be varied in the case of different types of pumps or a different design of the pumps. The ratio can also amount for example to 1:2, 1:4, 1:5 and so on or intermediate values.

The pressure-collecting chamber 68 is additionally provided with at least one cross-sectional constriction 82. The cross-sectional constriction 82 reduces the free cross-section of the pressure-collecting chamber 68, for example by a factor of 3:1 or by other factors analogous to the figures specified in conjunction with the cross-sectional enlargement 76. The cross-sectional constriction 82 is situated downstream of an opening 84 of the upper pressure duct 66 in the conveying direction of the fluid to be pumped.

At least one wall 86 inside the area 80 divides the area 80 of the pressure-collecting chamber 68 into chambers. At least one through opening 88 passes through the wall 86. The wall 86 can also be provided with a plurality of through openings 88, arranged for example in the manner of a screen. Instead of the wall 86 provided with the through openings 88, or in addition to it, a screen 89 can be arranged inside the area 80, preferably downstream of the opening 84.

A housing tongue 90, which leads to the formation of the pressure duct 70, projects from the housing wall 22. The housing tongue 90 directly adjoins the middle plate and the thrust plate 36 and can additionally be used as an assembly aid for the displacement unit 14. An over-run 92, which is situated as far towards the top as possible in the fitted position of the blocking-vane pump 10, is formed for the pressure-collecting chamber 68 by the formation of the housing tongue 90. The sealing device 34, which connects the cover 30 to the housing portion 20 in a pressure-tight manner, extends into the region of the housing tongue 90.

The spring chambers 60 are provided at their radially outer ends with respect to the rotation shaft 52 with a respective opening 92 connected by way of connections (not shown) to the pressure-collecting chamber 24. In addition, at least the lower spring chamber 60 is provided at its radially inner end with openings 94 which are arranged on both sides of the vane 58 and which are likewise connected by connections (not shown) to the pressure-collecting chamber 24. Openings 94 of this type can also additionally be connected to the upper spring chamber 60. Instead of the openings 94, the spring chambers 60 can also be provided with a round transition from the spring chambers 60 into the slots 56 (continuous transition) in the corner regions angled per se.

The blocking-vane pump 10 shown in FIGS. 1 and 2 operates as follows:

The rotor 48 is set in rotation by a drive means (not shown), so that the pumping behavior of the blocking-vane pump 10 already described takes place. In this case a fluid, for example diesel fuel, is conveyed from the suction connection 16 to the pressure connection 18 at increased pressure. The fuel is forced by the pressure ducts 66 into the pressure-collecting chamber 68 which is connected to the pressure outlet 18 by way of the pressure duct 70. The fluid issuing from the lower pressure duct 16 has to pass through the cross-sectional enlargement 76. This produces swirling of the fluid inside the area 80. As a result of the abrupt cross-sectional enlargement, a flow speed of the fluid is sharply reduced, so that a zone of little flow is formed for the fluid inside the area 80. This fluid passes through the through openings 88 provided in the wall 86 and is mixed there with the fluid issuing from the upper pressure outlet 66. The screen 89 arranged downstream of the opening 84 of the upper pressure outlet 66 likewise produces swirling of the fluid, i.e. inside the conveyed fluid there are quantities of fluid, the movement-direction vectors of which are not oriented in the direction of the pressure connection 18 during the operation of the blocking-vane pump 10.

These stages, namely the cross-sectional enlargement 76, the wall 86 with the through openings 88, the screen 89 as well as the cross-sectional constriction 82, have the effect that when a fluid supply through the suction connection 16 is interrupted, for example in so-called empty running of the tank of a motor vehicle, a residual quantity of fluid remains in the blocking-vane pump 10. Inside the area 80 the fluid swirled by the cross-sectional enlargement 76 is opposed by a flow resistance as a result of the following wall 86. This prevents the fluid from being drawn out of the pressure-collecting chamber 68 completely. The same effect takes place as a result of the swirling of the fluid in the area 81 of the pressure-collecting chamber 68 arranged downstream of the wall 86. The partial quantities of the fluid, the movement-direction vector of which is not quite oriented in the direction of the pressure outlet 18, are not conveyed further in the direction of the pressure outlet 18 when the pressure drops, but remain in the area 81 of the pressure-collecting chamber.

As a result of the design of the housing tongues 90, the over-run 92 of the pressure-collecting chamber 68 is displaced into the pressure duct 70 as far to the top as possible, as viewed in the fitted position of the blocking-vane pump 10. When the blocking-vane pump 10 is switched off, this likewise prevents fluid present in the pressure-collecting chamber 68 at the moment of switching-off from running off by way of the pressure duct 70 in the direction of the pressure connection 18 as a result of gravity.

The fluid remaining in the pressure chamber 68 can flow back in the direction of the pressure outlets 64 of the conveying chamber 46 as a result of gravity through the pressure ducts 66 arranged at the angle α. In this way, when the rotor 48 has stopped, a reservoir of the residual fluid is collected in the pump chambers 54 which are present in the region of the pressure outlets 64. As a result, when the blocking-vane pump 10 is started again, the fluid residue remaining in the conveying chamber 76 is immediately conveyed into the spring chambers 60 by way of the ducts 72 connecting the pressure outlets 64 to the spring chambers 60 and/or grooves arranged in the vanes 58. The spring chambers 60 can be vented through the openings 92 and 94 provided in the spring chambers 60, so that when fluid penetrates through the ducts 72 the filling of the spring chambers 60 with the residual fluid is not opposed by any resistance as a result of a diminishing volume of air inside the spring chambers 60. As a result of the introduction of the residual fluid into spring chambers 60, immediately after the blocking-vane pump 10 is started, it becomes possible in particular for gaps present between the vanes 58 and the slots 56 as well as between the radially extending narrow width edges of the vanes 58 and the end faces 28 and 38 respectively to be filled immediately with the fluid. This results in the gaps being sealed by a complete film of the fluid. This film of fluid which is immediately built up ensures that when the blocking-vane pump 10 is started, a build-up of pressure is possible immediately, since there is no connection by way of gaps between the moving and stationary parts of the displacement unit 14 and thus between the suction connection 16 and the pressure connection 18. Such a connection would produce a drop in pressure which would prevent the blocking-vane pump 10 from being able to run up immediately. The supply of a fluid begins immediately.

The retention of residual fluid in the blocking-vane pump 10 also takes place if the latter conveys only air, for example from an empty tank. This air is drawn-in the suction connection 16 and is passed on by the pressure connection 18, so that a blowing through of the blocking-vane pump 10 practically takes place. The wall 86, arranged inside the areas 80 of the pressure-collecting chamber 68, together with the at least one through opening 88 however, allows the conveyed air to pass through the through openings 88, but remaining residual fluid is retained by the closed areas of the wall 86. The same function is achieved by the screen 89. In this way, the blocking-vane pump 10 is prevented from running dry.

Since the greater part of the pressure-collecting chamber 68 is arranged above the conveying chamber 46, in the fitted position of the blocking-vane pump 10, the residual fluid retained in the pressure-collecting chamber 68 can return at any time into the conveying chamber 44 through the pressure ducts 66 then angled obliquely downwards at the angle α.

The openings 94 provided in the spring chambers 60 and the rounding of the spring chambers 60 which is provided there have the effect of preventing, in the areas of the spring chambers 60 which form dead angles, the occurrence of air inclusions which could obstruct the penetration of the fluid into the spring chambers 60. In particular, in the spring chamber 60 at the bottom, these openings 94 are arranged raised into a kevel, so that the air can escape.

The design of the pressure-collecting chamber 68 with its cross-sectional enlargements 76 and/or cross-sectional constrictions 82 and/or walls 86 and/or screens 89 can be taken into consideration in a simple manner during the manufacture of the housing 12 of the blocking-vane pump 10. As a result of the arrangement of the displacement unit 14 between the platform 26 of the housing portion 22 and the cover 30, the free space 24 forming the pressure-collecting chamber 68 is jointly applied in an equal manner. During the manufacture of the housing, for example by means of a die-casting process, the design of the pressure-collecting chamber 68 is possible with known methods in a simple manner by suitable shaping. The sealing device 34 between the cover 30 and the housing wall 22 and in particular also the housing tongue 90 prevents residual fluid from being able to issue from the pressure-collecting chamber 68 or the conveying chamber 44 respectively in an uncontrolled manner.

Figure 3:
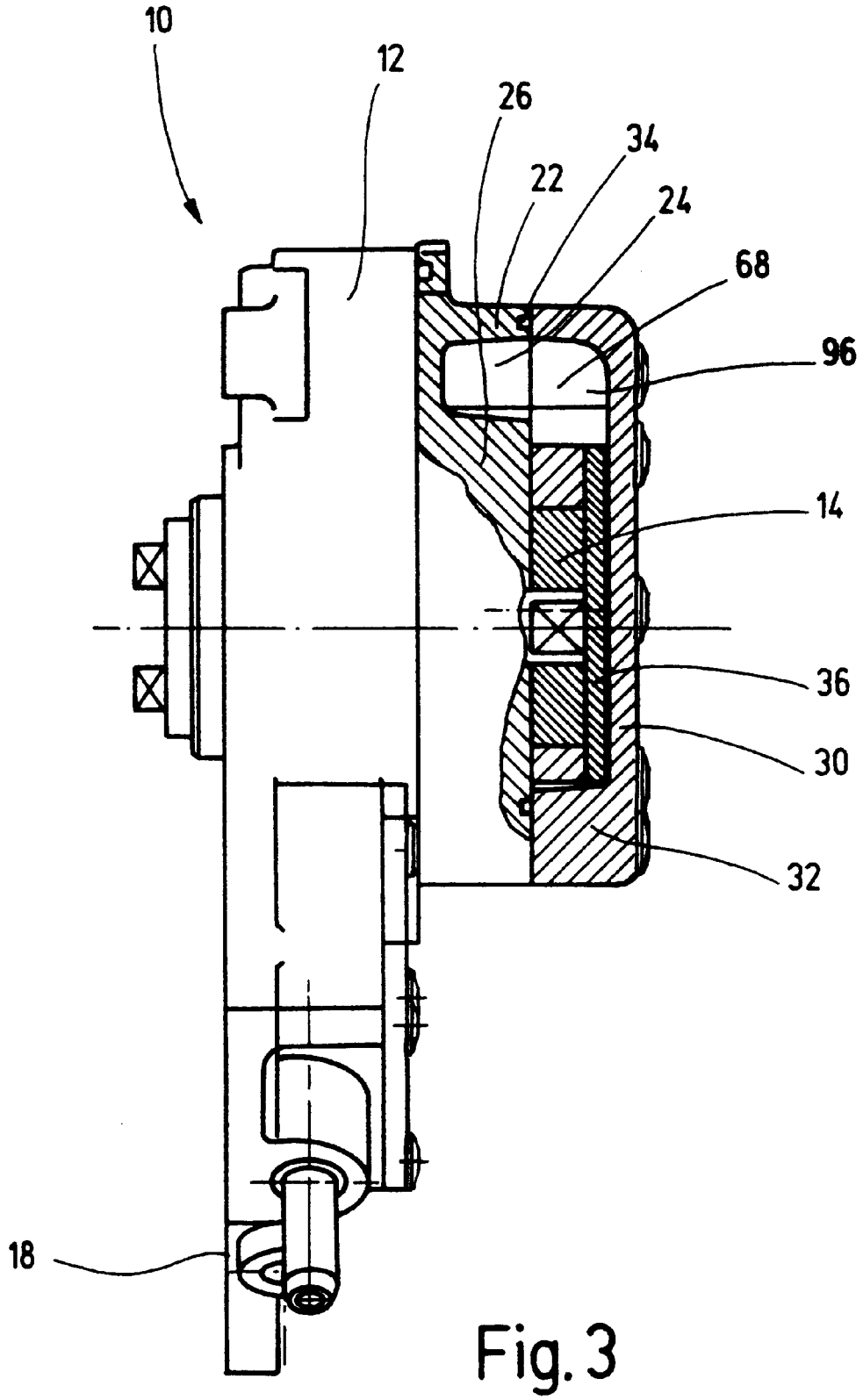
FIG. 3 is a view, partly in section, of a blocking-vane pump according to a further embodiment.

FIG. 3 shows a further variant embodiment of a blocking-vane pump 10, in which the same parts are provided with the same reference numerals as in FIG. 1 and are not explained further. The design and operation of the displacement unit 14 as well as the special arrangement of structural members, explained with reference to FIG. 2, for retaining residual fluid inside the blocking-vane pump 10 correspond in the embodiment in FIG. 3. In contrast to the embodiment illustrated in FIG. 1, here the housing wall 22 is of the height of and is in alignment with the platform 26. In this case, the cover 30 is cup-shaped, so that it likewise surrounds a free space 96, which together with the free space 24 forms the pressure-collecting chamber 68. In this case the displacement unit 14 is arranged inside the free space 96 of the cover 30. The cover 30 can preferably be produced from an aluminum die-casting, in a similar manner to the housing 12 of the blocking-vane pump 10. It is also possible, however, for the cover to comprise deep-drawn sheet metal, or the like.

The invention is not, of course, restricted to the embodiments illustrated. In this way, blocking-vane pumps 10 with a number of vanes 58 other than two are also possible, in which the pressure-collecting chamber 68 has the described shape and function, in particular for retaining a residual fluid in the blocking-vane pump 10, in particular in the conveying chambers 46. In addition, this principle can also be applied to other types of pumps, for example gear pumps, both internal-gear pumps and external-gear pumps, in which the pump chambers with varying volumes are produced by way of the rotation of gearwheels arranged relative to one another. The pressure outlets provided there can likewise be designed in such a way by way of a special arrangement of the pressure-collecting chamber as well as further steps described, that a residual fluid remains in the pump, which is used for sealing gaps between the movable and stationary parts immediately after the respective pump has been started.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A hydraulic conveying device for conveying liquid comprising a housing having a conveying chamber therein, a suction connection to the conveying chamber; a pressure connection to the conveying chamber;

a rotor in the conveying chamber rotatable with respect to the conveying chamber;

pump chamber forming devices in the housing communicating with the rotor in the conveying chamber for defining pump chambers of varying volume including increasing size pumping chambers connected with the suction connection and decreasing size pump chambers connected with the pressure connection for conveying fluid from the suction connection to the pressure connection as the rotor rotates;

retaining devices in the housing for retaining a quantity of the fluid being conveyed in the conveying chamber when the supply of fluid from the suction connection to the conveying chamber is interrupted, the retaining devices comprise a pressure collecting chamber for retaining fluid and being located substantially above the conveying chamber during operation of the conveying device;

pressure ducts from the decreasing size pump chambers which are pressurized by rotation of the rotor, the pressure ducts extending upward at an angle to an imaginary horizontal line extending through the rotation axis of the rotatable rotor, and the pressure ducts extending into the pressure collecting chamber; the pressure collecting chamber being shaped with at least one enlargement cross-section for causing swirling; the pressure collecting chamber is shaped with at least one cross-sectional constriction for causing swirl;

at least one partition wall arranged transversely to the flow direction of the fluid in the pressure chamber and having at least one through opening through the partition wall for the fluid, the partition wall being positioned in an area in the pressure chamber between the cross-sectional enlargement and the cross-sectional constriction.

2. The conveying device of claim 1, wherein at least one pressure duct extends upward to the pressure collecting chamber in a straight line.

3. The conveying device of claim 1, wherein at least one pressure duct has a generally curved shape extending upward to the pressure collecting chamber.

4. The hydraulic conveying device of claim 1, wherein at least one cross-section enlargement is arranged downstream of a lower one of the pressure ducts in the conveying direction of the fluid through the pressure collecting chamber.

5. The pressure collecting device of claim 1, wherein the pressure collecting chamber is shaped with at least one cross-sectional constriction for causing swirl.

6. The conveying device of claim 1, wherein the constriction is arranged downstream in the conveying direction of the fluid of an opening of an upper one of the pressure ducts;

the partition wall being arranged upstream of the opening of the upper one of the pressure ducts.

7. The conveying device of claim 1, wherein the conveying device is a blocking vane pump.

8. The conveying device of claim 1, further comprising pressure outlets from the decreasing size pump chambers to the pressure ducts;

the pump chamber forming devices comprise vanes supported in the conveying chamber, and the vanes being urged against the rotor, the rotor being shaped to cooperate with the vanes to define the pump chambers.

9. The conveying device of claim 8, further comprising springs acting on the vanes for urging the vanes radially against the rotor in the conveying chamber.

10. The conveying device of claim 8, further comprising a fluid connection to the vanes for urging the vanes radially against the rotor for defining the pump chambers.

11. The conveying device of claim 10, wherein the conveying device includes means defining the conveying chamber, a middle plate at one end side of the conveying chamber and of the rotor, and an outer plate at the other axial side of the conveying chamber and the rotor and the fluid connection comprises at least one duct arranged in the middle plate.

12. The conveying device of claim 10, further comprising springs acting on the vanes for urging the vanes radially against the rotor in the conveying chamber.

13. The conveying device of claim 12, further comprising spring chambers in the housing for containing the springs, and the fluid connection from each pressure outlet is to one of the spring chambers radially outward of each vane for supplying pressure on the vane to urge the vane radially inwardly.

14. The hydraulic conveying device of claim 13, comprising at least one opening to the spring chamber in the housing and the fluid connection is between the opening to the spring chamber and the pressure collecting chamber.

15. The conveying device of claim 1, wherein the pressure collecting chamber is shaped so that the cross-section enlargement is abrupt and so that a ratio of the cross-sections of the pressure collecting chamber upstream of and downstream of the cross-section enlargement is at least 1:2.

16. The conveying device of claim 15, wherein the ratio is at least 1:3.

17. The conveying device of claim 1, wherein the at least one cross-sectional constriction is abrupt and wherein a ratio of the cross-sections of the pressure collecting chamber upstream of the cross-sectional enlargement and downstream of the cross-sectional constriction is at least 2:1.

18. The conveying device of claim 17, wherein the ratio is at least 3:1.

19. The conveying device of claim 17, wherein the constriction is arranged downstream in the conveying direction of the fluid of an opening of an upper one of the pressure ducts.

20. The conveying device of claim 1, further comprising a screen arranged inside an area of swirling downstream in the conveying direction of at least one of the cross-sectional enlargement and the cross-sectional constriction.

21. The conveying device of claim 20, wherein the screen is arranged downstream of the upper one of the pressure ducts.

22. The conveying device of claim 1, wherein the pressure collecting chamber comprises a free space defined by the housing and a pressure tight cover closeable over the free space.

23. The conveying device of claim 22, wherein the free space is further bounded by an outer wall of the housing and by a platform surrounded by the outer housing wall, the platform being positioned for acting as an abutment for the pump chamber defining devices.

24. The conveying device of claim 22, wherein the cover is a shaped cover over the free space of the pressure collecting chamber.

25. The conveying device of claim 22, further comprising a housing tongue forming an over-run for the pressure collecting chamber and being formed inside the free space of the chamber.

26. The conveying device of claim 25, wherein the over-run is arranged toward the top of the pressure collecting chamber.

* * * * *